United States Patent [19]

Lieb et al.

[11] Patent Number: 4,682,560

[45] Date of Patent: Jul. 28, 1987

[54] HIGH FORCE RELEASE AND RESET MECHANISM FOR SUPPORTING A STRUCTURE FROM A BOAT HULL

[75] Inventors: M. Jeremy Lieb, Waukegan; Raymond D. Collis, Round Lake, both of Ill.

[73] Assignee: Outboard Marine Corporation, Waukegan, Ill.

[21] Appl. No.: 752,647

[22] Filed: Jul. 8, 1985

[51] Int. Cl.[4] ..... B63B 49/00

[52] U.S. Cl. ..... 114/343; 114/284; 114/285; 16/257

[58] Field of Search ..... 114/132, 138, 141, 145 A, 114/284, 285, 353, 162; 440/79; 16/232, 257, 321, 334; 73/170 A, 181, 184, 185, 186, 187

[56] References Cited

U.S. PATENT DOCUMENTS

| | | | |
|---|---|---|---|
| 2,391,861 | 1/1946 | Bellows . | |
| 2,812,522 | 11/1957 | Wilson . | |
| 2,812,536 | 11/1957 | Ragsdale . | |
| 2,853,924 | 9/1958 | Herzfeld et al. . | |
| 3,077,880 | 2/1963 | Morton . | |
| 3,085,540 | 4/1963 | Crabille | 114/162 |
| 3,269,347 | 8/1966 | Koenig | 114/162 |
| 3,568,618 | 3/1971 | Bedford . | |
| 3,965,838 | 6/1976 | Uht | 114/145 A |
| 4,036,507 | 7/1977 | Henderson | 114/344 |
| 4,193,164 | 3/1980 | Okayama . | |
| 4,318,196 | 3/1982 | Eide | 114/344 |

*Primary Examiner*—Joseph F. Peters, Jr.

*Assistant Examiner*—Thomas J. Brahan

*Attorney, Agent, or Firm*—Michael, Best & Friedrich

[57] ABSTRACT

Apparatus for pivotally mounting a structure on a boat hull for pivotal movement between a position wherein the structure extends downwardly into the water and a retracted position. The apparatus includes a first hinge member adapted to be fixed to the boat hull, and having a pair of spaced apart flanges including apertures. A second hinge member adapted to support the structure, is positioned between the spaced apart flanges and pivotally connected to said first hinge member for pivotal movement with respect to said first hinge member between a first position and a second position, said second hinge member including, a first side having a surface adjacent one of said spaced flanges of said first member, and said first side including an aperture, a second side having a surface adjacent the other of said spaced flanges of said first member, means for pivotally connecting said second hinge member to said first hinge member such that said second hinge member is moveable with respect to said first hinge member between said first position and said second position, and detent means for releasably holding said second hinge member in said first position, said detent means including a ball carried by said second hinge member for movement toward and away from said one of said spaced flanges of said first hinge member, and spring means for resiliently biasing said ball toward said one of said spaced flanges, and a portion of said ball being housed in said aperture when said second hinge member is in said first position.

12 Claims, 5 Drawing Figures

HIGH FORCE RELEASE AND RESET MECHANISM FOR SUPPORTING A STRUCTURE FROM A BOAT HULL

FIELD OF THE INVENTION

The invention relates to apparatus adapted to be mounted on a boat hull and for use in supporting a device from the boat hull.

BACKGROUND PRIOR ART

Attention is directed to the Bedford U.S. Pat. No. 3,568,618, issued Mar. 9, 1971 and the Ragsdale U.S. Pat. No. 2,812,536 issued Nov. 12, 1957.

Attention is further directed to the Morton U.S. Pat. No. 3,077,880, issued Feb. 19, 1963; the Wilson U.S. Pat. No. 2,812,522, issued Nov. 12, 1957; the Okayama U.S. Pat. No. 4,193,164, issued Mar. 18, 1980; the Herzfeld et al. U.S. Pat. No. 2,853,924, issued Sept. 30, 1958 and the Bellows U.S. Pat. No. 2,391,861, issued Jan. 1, 1946.

SUMMARY OF THE INVENTION

The invention includes an apparatus for releaseably supporting a structure from a boat hull for movement through the water with the boat. The apparatus includes a first hinge member adapted to be fixed to the boat hull and second hinge member for supporting the structure, the second hinge member being supported for pivotal movement with respect to said first hinge member between a first position and a second position. The second hinge member includes a second surface portion closely adjacent a first surface portion of the first hinge member, and the second surface portion faces the first surface portion of the first hinge member. Means are also provided for pivotally joining the first hinge member and the second hinge member such that the second hinge member is pivotable with respect to the first hinge member between the first position and the second position. Means are further provided for releaseably holding the second hinge member in the first position, this means including at least one indentation in one of the first or second surface portions, and a moveable member carried by the other of the first hinge member and the second hinge member. A portion of the moveable member is housed in the indentation when the second hinge member is in the first position. Means are also provided for resiliently biasing the moveable member into engagement with the selected hinge member when the second hinge member is in the first position.

In one embodiment of the invention the first hinge member includes a bite portion adapted to be secured to the boat hull and a pair of substantially parallel flanges projecting from the bite portion. The second hinge member includes a flange adjacent one of the flanges of the first hinge member, and at least one of the flanges of the first or second hinge member includes the indentation.

In one embodiment of the invention, the moveable member comprises a ball carried by one of the first or second hinge members and supported for movement between a retracted position wherein the second hinge member is freely moveable with respect to the first hinge member, and wherein the ball comprises a bearing between the first hinge member and the second hinge member, and a detent position wherein at least a portion of the ball is housed in the indentation in the selected one of the flanges and functions as a wedge between the first hinge member and the second hinge member.

In one embodiment of the invention the means for releaseably holding the second hinge member in the first position includes a compression spring carried by one of the first and second hinge members and resiliently biasing the ball toward the selected one of the flanges.

In one embodiment of the invention the means for releaseably holding includes a pair of balls supported by one of the first and second hinge members and projecting from opposite sides of that hinge member, and a compression spring supported between the balls and forcing the balls against the flanges of the other hinge member. The balls provide bearings as the second hinge member moves between the first and second positions. Each of the flanges of the other hinge member includes an aperture, and the balls are housed in apertures in the flanges of the other hinge member when the second hinge member is in the first position to releaseably restrain the second hinge member from movement to the second position.

Various other features of the invention will be apparent from the following description of a preferred embodiment, from the drawings and from the claims.

Figure 1:
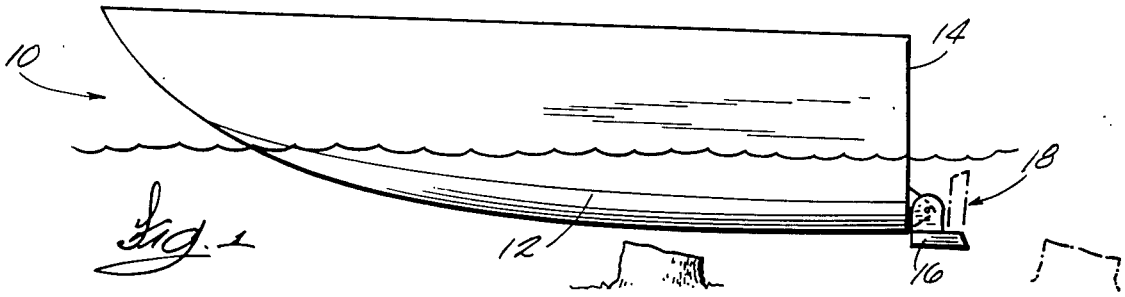
FIG. 1 is a side elevation view of a boat supporting an apparatus embodying the invention.

Before describing one embodiment of the invention in detail, it is to be understood that the invention is not limited in its application to the details of construction set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

FIG. 1 illustrates a boat 10 having a hull 12 and a transom 14. Also included is a depending structure 16 supported by a hinge assembly 18 rearwardly of the transom 14 and such that the depending structure 16 may extend downwardly into the water. While in one form of the invention the depending structure supported by the hinge assembly 18 can comprise a conventional transducer of the type used with power boats, in other constructions the hinge assembly 18 could be used to support other structures of the type adapted to be supported by a boat hull and for extension into the water. The hinge assembly 18 supports the transducer 16 for selective movement between the position shown in solid lines in FIG. 1 and a second position shown in phantom lines wherein the transducer 18 is raised or positioned above the bottom of the boat hull 12.

Referring more particularly to the construction of the hinge assembly 18, it includes a first hinge member 20 adapted to be secured to the transom 14 of the boat hull adjacent the bottom of the boat, the first hinge member 20 including a bite portion 22 adapted to be fixed to the transom 14 and a pair of planar rearwardly extending flanges 23 and 24. In the illustrated arrangement, the flanges 23 and 24 define spaced apart parallel planar outer surfaces 26. A second hinge member 28 is pivotally supported by the first hinge member 20 and supports the transducer 16 for pivotal movement between a first position wherein the transducer 16 is held beneath the plane of the bottom of the boat hull 12 and a second position wherein the transducer 16 is raised or held in a position rearwardly of the transom 14. While the second hinge member 28 could be constructed in other ways, in the illustrated arrangement, it includes a bite portion 30 and a pair of spaced apart planar flanges 32 and 34 extending from the bite portion. The planar flanges 32 and 34 are positioned in closely adjacent parallel relation with respect to the flanges 23 and 24 of the first hinge member 20.

Means are also provided for pivotally joining the second hinge member 28 to the first hinge member 20 for pivotal movement about a pivot axis transverse to the planes defined by the flanges 23, 24, 32 and 34 of the first and second hinge members. While the means for pivotally joining the hinge members 20 and 28 could be constructed in various ways, in the illustrated arrangement a pivot pin 38 extends through aligned bores provided in the flanges 23, 24, 32 and 34 of the hinge members 20 and 28, and the pivot pin 38 has a longitudinal axis perpendicular to the planes defined by the flanges of the hinge members.

Means are also provided for biasing the second hinge member toward the first position, i.e., the position wherein the transducer 16 supported by the hinge assembly is below the plane of the bottom of the boat. While various means could be provided, in the arrangement illustrated in the drawings, this means includes a torsion spring 40 surrounding the pivot pin 38 and having one end 42 engaging one of the hinge members and an opposite end 44 supported or engaging the other of the hinge members.

Means are further provided for releaseably restraining the second hinge member 28 in the position shown in FIGS. 2 and 3 wherein the transducer 16 is held below the plane of the bottom of the hull 12. This means includes at least one ball 46 supported by one of the first and second hinge members 20 and 28 and adapted to function as a detent and to extend into an indentation or cavity provided in one of the flanges of the other hinge member. In the arrangement illustrated in FIGS. 2 and 3, the hinge assembly includes a pair of balls 46 carried by the first hinge member 20, and with one of the balls adapted to engage one of the flanges 32 of the second hinge member 28 and with the other ball 46 adapted to engage the other flange 34 of the second hinge member 28. The balls 46 are supported for resilient movement toward and away from the opposing surfaces of the flanges 32 and 34 of the second hinge member 28. In the particular arrangement illustrated in the drawings, the balls 46 are housed in opposite ends of a tube 50 fixed between the flanges 23 and 24 of the first hinge member, the tube 50 having a longitudinal axis parallel to the longitudinal axis of the pivot pin 38 and being spaced from the pivot pin 38. The balls 46 project from the opposite ends of the tube 50 through apertures 52 provided in the flanges 23 and 24 of the first hinge member 20 and engage the inner planar surfaces 54 of the flanges 32 and 34 of the second hinge member 28.

Means are also provided for resiliently biasing the balls 46 into engagement with the inner surfaces 54 of the flanges 32 and 34. In the arrangement illustrated, this means includes a compression spring 58 housed in the tube 50 and between the balls 46 and having opposite ends engaging the balls 46 and forcing them outwardly into engagement with the flanges 32 and 34. When the hinge assembly is in the position shown in solid lines in FIGS. 2 and 3, portions of the balls 46 are housed in apertures or holes 60 provided in the flanges 32 and 34 and the compression spring 58 will apply an outward force on the balls 46 to hold the balls 46 in the apertures 60. When in this position, the balls 46 function as wedges to resist any movement of the second hinge member 28 with respect to the first hinge member 20.

When sufficient force is applied to the second hinge member 28, the balls 46 will be forced into the tube 50 and out of the apertures 60 in the flanges 32 and 34. Once the balls are moved out of the apertures 60, thereby permitting pivotal movement of the hinge members 20 and 28 with respect to one another, the balls 46 then function as rolling bearings to support the hinge members for movement with respect to one another, and the balanced force of the balls 46 on the flanges 32 and 34 of the second hinge member 28 functions to center the second hinge member with respect to the first hinge member as the hinge members pivot with respect to one another.

In a preferred form of the invention, the compression spring 58 will apply sufficient outward force on the balls 46 such that the transducer 16 will be held in the downward position during movement of the boat through the water. The restraining force by the balls 46 in the apertures 60 should not be so great, however, as to prevent the second hinge member 28 from pivoting to its retracted position in the event the transducer 16 strikes an obstruction in the water as the boat moves through the water. Once the balls 46 are forced out of the apertures 60, and the second hinge member 28 begins to pivot with respect to the first hinge member, the second hinge member can pivot freely with the balls 46 functioning as rolling bearings between the flanges of the first and second hinge members.

After the obstruction is cleared, the torsion spring 40 will then force the second hinge member 28 back to its first position.

Figure 3:
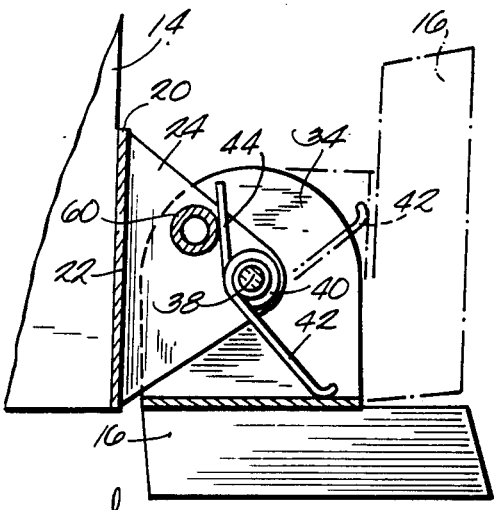
FIG. 3 is a cross section view taken along line 3—3 in FIG. 2.
Figure 2:
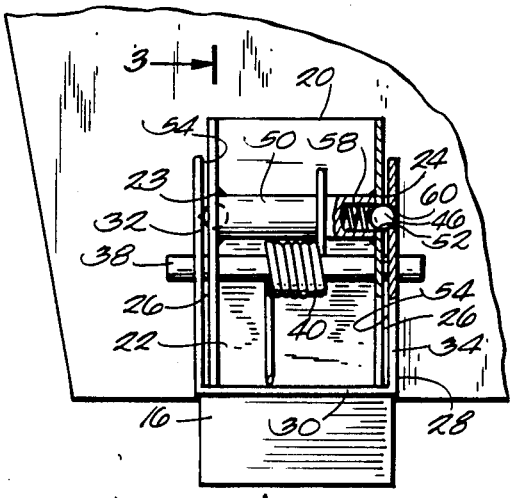
FIG. 2 is an enlarged end elevation view of the apparatus illustrated in FIG. 1.
Figure 5:
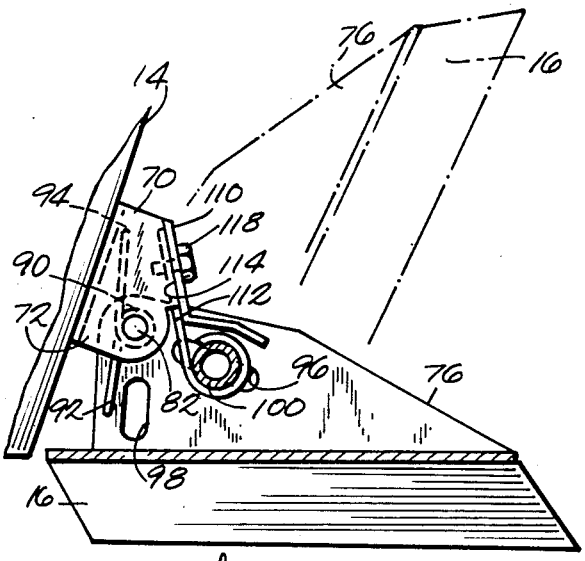
FIG. 5 is a cross section view taken along line 5—5 in FIG. 4.
Figure 4:
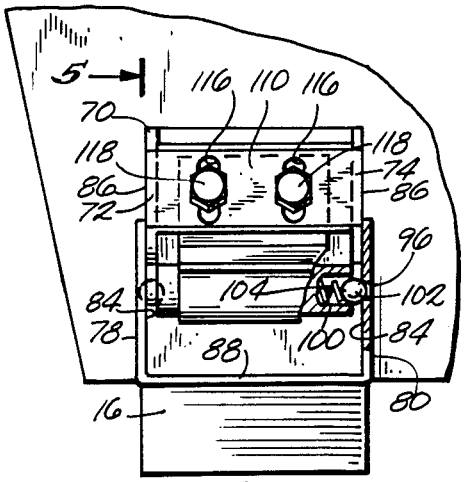
FIG. 4 is a view similar to FIG. 2 and showing an alternative embodiment of the apparatus illustrated in FIGS. 2 and 3.

FIGS. 4 and 5 illustrate an alternative embodiment of the hinge assembly illustrated in FIGS. 2–3. The hinge assembly illustrated in FIGS. 4 and 5 includes a first hinge member 70 adapted to be secured to the boat transom 14, the first hinge member 70 including spaced parallel flanges 72 and 74 projecting rearwardly from the transom 14. The hinge assembly also includes a second hinge member 76 having a pair of parallel flanges 78 and 80, and the second hinge member 76 is pivotally connected by a pivot pin 82 to the first hinge member 70. The flanges 78 and 80 of the second hinge member 76 include planar surfaces 84 positioned in closely spaced adjacent relation to opposed planar surfaces 86 of the flanges 72 and 74 of the hinge member 70. The second hinge member 76 also includes a bite portion 88 adapted to support a structure such as a transducer 16 for movement from the position shown in solid lines in FIG. 5 to the position shown in phantom.

Means are also provided for biasing the transducer 16 toward the position shown in solid lines in FIG. 5 wherein the transducer 16 is held beneath the bottom of the boat. In the construction shown in FIGS. 4 and 5, this means includes a torsion spring 90 surrounding the pivot pin 82 and including one of its opposite ends 92 engaging one of the hinge members and the other opposite end 94 connected to the other hinge member.

Means are also provided for releaseably holding the second hinge member 76 in a selected one of a first detent position and a second detent position. In the illustrated construction, this means comprises a first set of apertures 96 in the flanges 78 and 80 of the second hinge member 76 and a second set of apertures 98 in the flanges of the second hinge member. A tube 100 supported by the first hinge member 70 is positioned between the spaced flanges 78 and 80 of the second hinge member 76, and a pair of balls 102 are housed in the opposite ends of the tube 100. A compression spring 104 is housed in the tube 100 between the balls 102 and applies an outward force on the balls 102 causing them to be forced into engagement with the flanges 78 and 80 of the second hinge member 76. The apertures 96 and 98 provided in the flanges are arranged such that when the hinge-members are positioned as shown in solid lines in FIG. 5, the balls 102 are housed in apertures 96, and when the second hinge member 76 is in the second position or phantom position as shown in FIG. 5, the balls 102 are housed in the second set of apertures 98 and releaseably restrain the transducer 16 in a raised or retracted position.

Means are also provided for adjusting the detent positions of the supported structure 16 with respect to the transom 14. In the illustrated construction of FIGS. 4 and 5, each of the apertures 96 and 98 comprises a slot. Means are also provided for supporting the tube 100 for movement to adjust the position of the second hinge member with respect to the first hinge member and with respect to the second hinge member 76 and with respect to the transom 14. The means for supporting the tube 100 for movement includes a transverse web member 110 joining the rearward edges of the flanges 72 and 74 of the first hinge member 70. The tube 100 is integrally joined to a lower portion of a plate 112 supported for generally vertical slideable engagement against a rearward planar surface 144 of the transverse web member 110. The plate 112 is generally vertically slideably movable with respect to the first hinge member 70 to provide for adjustment of the relative position of the tube 100 with respect to the first hinge member 70 and the second hinge member 76. More specifically, the transverse web member 110 is provided with a pair of linear generally vertically extending slots 116. Bolts 118 extend through the slots 116 are received in threaded bores provided in the plate 112 and the bolts 118 can be tightened to secure the plate 112 to the transverse web member 110. If the bolts 118 are loosened, the tube 100 can move vertically with respect to the transverse web member 110, and such movement of the tube 100 is accommodated by the slots 116. Such movement of the tube 100 and the balls 102 with respect to the second hinge member 76 functions to adjust the relative position of the second hinge member first and second positions.

Various features of the invention are set forth in the following claims.

We claim:

1. Apparatus for releasably supporting a structure from a boat hull, said apparatus comprising a first hinge member adapted to be fixed to the boat hull, said first hinge member including a first surface portion, a second hinge member for supporting the structure and including a second surface portion closely adjacent and facing said first surface portion of said first hinge member, means for pivotally joining said first hinge member and said second hinge member such that said second hinge member is pivotable with respect to said first hinge member about a horizontal axis between a first rearwardly extending position and a second upwardly extending position, means for biasing said second hinge member toward said first position, and means releasably holding said second hinge member in said first position and including at least one indentation in one of said first surface portion of said first hinge member and said second surface portion of said second hinge member, a member carried by the other of said first hinge member and said second hinge member for movement relative thereto in directions parallel to said horizontal axis and relative to said indentation for receipt therein when said second hinge member is in said first position, and means for resiliently biasing said moveable member into engagement with said indentation when said second hinge member is in said first position.

2. Apparatus as set forth in claim 1 wherein said first hinge member includes a bite portion adapted to be secured to the boat hull and a pair of substantially parallel flanges projecting from said bite portion, wherein at least a portion of said second hinge member is positioned adjacent one of said flanges of said first hinge member and wherein at least one of said flanges of said first hinge member includes said indentation.

3. Apparatus for releaseably supporting a structure from a boat hull, said apparatus comprising a first hinge member adapted to be fixed to the boat hull and including a first surface portion, a second hinge member for supporting the structure and including a second surface portion closely adjacent to and facing said first surface portion of said first hinge member, means for pivotally joining said first hinge member and said second hinge member for pivotal movement of said second hinge member about an axis and between a first position and a second position, and means for releasably holding said second hinge member in said first position and including at least one indentation in one of said first surface portion of said first hinge member and said second surface portion of said hinge member, a ball carried by the other of said first hinge member and said second hinge member and supported for movement relative to said hinge members in directions parallel to said axis and between a retracted position wherein said second hinge member is freely movable with respect to said first hinge member and wherein said ball comprises a bearing between said first hinge member and said second hinge member, and a detent position wherein at least a portion of said ball is housed in said indentation and functions as a wedge between said first hinge member and said second hinge member when said second hinge member is in said first position, and means for resiliently biasing said ball into engagement with said indentation when said second hinge member is in said first position.

4. Apparatus as set forth in claim 3 and wherein said means for releaseably holding said second hinge member in said first position includes a compression spring carried by said second hinge member and resiliently biasing said ball toward a portion of said first hinge member.

5. Apparatus for releaseably supporting a structure from a boat hull, said apparatus comprising a first hinge member adapted to be fixed to the boat hull and including a pair of spaced flanges, a second hinge member for supporting the structure and including a pair of spaced flanges closely adjacent to and facing said flanges of said first hinge member, means for pivotally joining said first hinge member and said second hinge member for pivotable movement of said second hinge member relative to said first hinge member between a first position and a second position, and means for releasably holding said second hinge member in said first position and including respective indentations in said flanges of one of said first and second hinge members, a pair of balls supported by the other of said first and second hinge members, and a compression spring supported between said balls and forcing said balls toward said flanges of said one of said first and second hinge members, said balls providing bearings as said second hinge member moves between said first and said second positions and wherein said balls are housed in said indentations in said flanges of said one of said first and second hinge members when said second hinge member is in said first position to releasably restrain said second hinge member from movement from said first position.

6. Apparatus for releasably supporting a structure from a boat hull, said apparatus comprising a first hinge member including a bite portion adapted to be fixed to the boat hull and a pair of substantially parallel flanges projecting from said bite portion, one of said flanges including an indentation, a second hinge member for supporting the structure and including a bite portion adapted to support said structure and a pair of spaced parallel flanges projecting from said bite portion, one of said parallel flanges of said second hinge member being positioned in closely adjacent parallel and facing relation to one of said flanges of said first hinge member, and the other of said parallel flanges of said second hinge member being positioned in closely adjacent parallel and facing relation to the other of said flanges of said first hinge member, means for pivotally joining said first hinge member and said second hinge member such that said second hinge member is pivotable with respect to said first hinge member between a first rearwardly extending position and a second upwardly extending position, means for biasing said second hinge member toward said first position, and means for releasably holding said second hinge member in said first position and including at least one indentation in one of said first surface portion of said first hinge member and said second surface portion of said second hinge member, a moveable member carried by the other of said first hinge member and said second hinge member, a portion of said moveable member being housed in said indentation when said second hinge member is in said first position, and means for resiliently biasing said moveable member toward said indentation when said second hinge member is in said first position.

7. Apparatus for releasably supporting a structure from a boat hull, said apparatus comprising a first hinge member adapted to be fixed to the boat hull, said first hinge member including a first surface portion, a second hinge member for supporting the structure and including a second surface portion closely adjacent and facing said first surface portion of said first hinge member, means for pivotally joining said first hinge member and said second hinge member such that said second hinge member is pivotable with respect to said first hinge member between a first rearwardly extending position and a second upwardly extending position, means including a torsion spring for biasing said second hinge member toward said first position, and means for releasably holding said second hinge member in said first position and including at least one indentation in one of said first surface portion of said first hinge member and said second surface portion of said second hinge member, a moveable member carried by the other of said first hinge member and said second hinge member, a portion of said moveable member being housed in said indentation when said second hinge member is in said first position, and means for resiliently biasing said moveable member toward said indentation when said second hinge member is in said first position.

8. Apparatus for pivotally mounting a structure on a boat hull, said apparatus comprising a first hinge member adapted to be fixed to the boat hull and including a surface, a second hinge member adapted to support the structure and including a surface adjacent said surface of said first member, means for pivotally connecting said second hinge member to said first hinge member about a generally horizontal axis for movement between a first position and a second position, and detent means for releaseably holding said second hinge member in one of said positions and including an aperture in said surface of one of said first and second hinge members, a ball carried by the other of said first and second hinge members for horizontal movement relative to said first and second hinged members, and spring means extending in generally parallel relation to said horizontal axis for resiliently biasing said ball toward receipt in said aperture in said one of said first and second hinge members.

9. Apparatus for pivotally mounting a structure on a boat hull, said apparatus comprising a first hinge member adapted to be fixed to the boat hull and including a pair of spaced apart flanges, a second hinge member adapted to support the structure and including a pair of spaced apart flanges respectively adjacent said spaced flanges of said first member, means for pivotally connecting said second hinge member to said first hinge member for movement of said second hinge member relative to said first hinge member between a first position and a second position, and detent means for releasably holding said second hinge member in said first position and including respective apertures in each of said flanges of said second hinge member, a pair of balls carried by said first hinge member, and a compression spring positioned between said balls and forcing said balls toward said spaced apart flanges of said second hinge member and for respective partial receipt in said apertures.

10. Apparatus as set forth in claim 9 wherein a portion of one of said balls is housed in one of said apertures and a portion of the other of said balls is housed in the other of said apertures when said second hinge member is in said first position.

11. Apparatus for releaseably supporting a structure from a boat hull for movement through water with the boat hull, the apparatus comprising a first hinge member including a bite portion adapted to be fixed to the boat hull and a pair of substantially parallel flanges projecting from said bite portion with at least one of said flanges including an indentation, a second hinge member for supporting the structure, said second hinge member including a portion positioned adjacent one of said flanges of said first hinge member in facing relation thereto, means for pivotally joining said first hinge member and said second hinge member such that said second hinge member is pivotable with respect to said first hinge member between a first portion and a second position, and means for releasably holding said second hinge member in said first position and including said indentation, a ball carried by said second hinge member, and means for resiliently biasing said ball toward said indentation when said second hinge member is in said first position.

12. Apparatus as set forth in claim 11 and wherein said means for releasably holding said second hinge member in said first position includes a compression spring carried by said second hinge member and resiliently biasing said ball toward a portion of said first hinge member.

* * * * *